US008608931B2

(12) United States Patent
Zhang-Beglinger et al.

(10) Patent No.: US 8,608,931 B2
(45) Date of Patent: Dec. 17, 2013

(54) ANTI-DISPLACEMENT HARD GOLD COMPOSITIONS

(75) Inventors: Wan Zhang-Beglinger, Adligenswil (CH); Jonas Guebey, Lucerne (CH); André Egli, Lucerne (CH)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 191 days.

(21) Appl. No.: 12/887,909

(22) Filed: Sep. 22, 2010

(65) Prior Publication Data

US 2011/0147220 A1 Jun. 23, 2011

Related U.S. Application Data

(60) Provisional application No. 61/277,503, filed on Sep. 25, 2009.

(51) Int. Cl.
*C25D 3/62* (2006.01)

(52) U.S. Cl.
USPC ..... 205/247; 205/238; 205/266

(58) Field of Classification Search
USPC ..... 205/118, 238, 247, 266, 122, 133
See application file for complete search history.

(56) References Cited

U.S. PATENT DOCUMENTS 4,367,123 A 1/1983 Beck
4,591,415 A * 5/1986 Whitlaw ..... 205/125
6,627,329 B1 9/2003 Shintani
6,911,068 B2 6/2005 Cobley et al.
7,465,385 B2 12/2008 Egli et al.
7,591,911 B2 9/2009 Senda et al.
2006/0283714 A1 * 12/2006 Egli et al. ..... 205/242
2007/0284258 A1 12/2007 Yoshimoto et al.

FOREIGN PATENT DOCUMENTS

EP 1 728 898 12/2006
WO WO 02/101119 12/2002

OTHER PUBLICATIONS

European Search Report of corresponding European Application No. 10 17 8645, Dec. 2010.

Shervedani et al.; "Comparative electrochemical study of self-assembled monolayers of 2-mercatobenzoxasole, 2-mercaptobenzothiazole, and 2-mercaptobenzimidazole formed on polycrystalline gold electrode"; Electrochimica Acta, vol. 52, No. 24; Jul. 9, 2007; pp. 7051-7060.

John G. Donaldson; "Continuous Strip Plating of Electronic Components", Metal Finishing, vol. 93, No. 1, pp. 572-584, May 21, 2007.

* cited by examiner

*Primary Examiner* — Luan Van
*Assistant Examiner* — Louis Rufo
(74) *Attorney, Agent, or Firm* — John J. Piskorski

(57) ABSTRACT

Anti-displacement hard gold compositions are disclosed for inhibiting displacement of metal from substrates which are plated with the hard gold. The anti-displacement hard gold compositions may be used to spot plate substrates with hard gold.

6 Claims, 1 Drawing Sheet

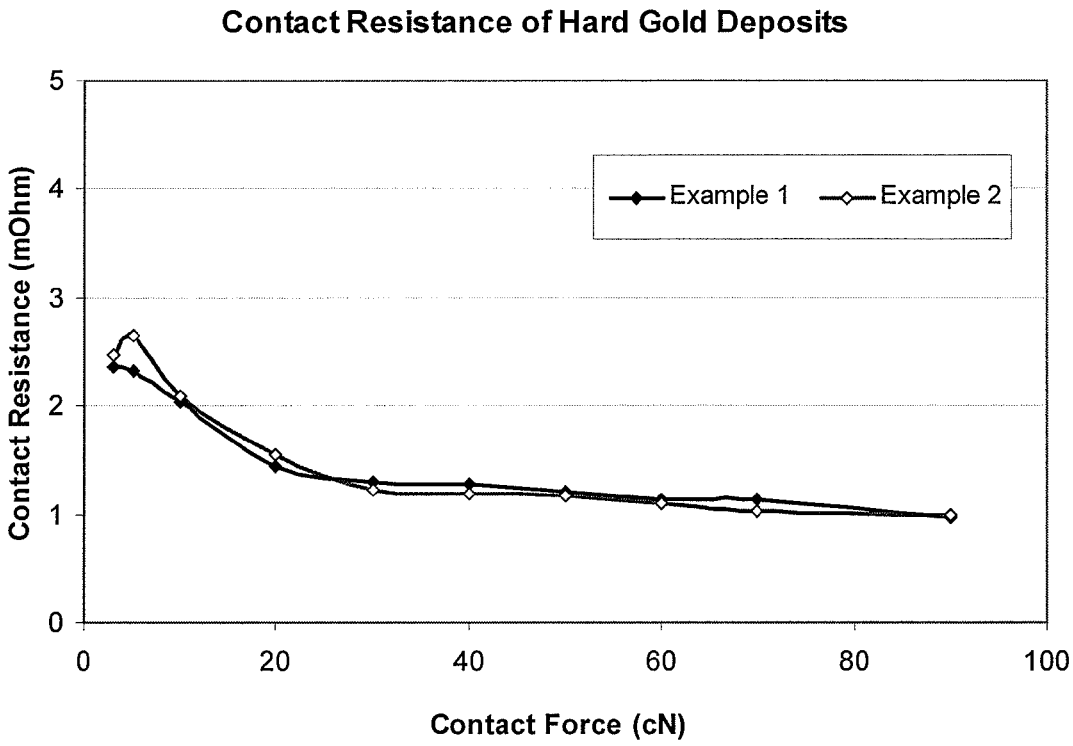
Contact Resistance of Hard Gold Deposits
Contact Resistance (mOhm)
5
4
3
2
1
0
0
20
40
60
80
100
Contact Force (cN)
Example 1
Example 2

ANTI-DISPLACEMENT HARD GOLD COMPOSITIONS

This application claims the benefit of priority under 35 U.S.C. §119(e) to U.S. Provisional Application No. 61/277,503, filed Sep. 25, 2009, the entire contents of which application are incorporated herein by reference.

The present invention is directed to anti-displacement hard gold compositions. More specifically, the present invention is directed to anti-displacement hard gold compositions containing compounds which inhibit gold ions from displacing nickel from substrates being plated with the hard gold.

Hard gold or gold alloys of cobalt and nickel have been widely used as contact material of electrical connectors for high reliability applications. Connectors having hard gold end layers are often electroplated over nickel substrates, such as nickel plated on copper. In general, selective plating techniques, such as spot plating, significantly reduce material cost of connectors by limiting the plating area of gold and other precious metals, such as palladium and palladium-nickel alloys.

Spot plating is a fairly new type of electroplating that focuses on a specific spot in order to decrease the cost of plating gold and other precious metals. Spot plating is used to provide precious metal only where it is functionally required. Spot plating has been used predominantly to apply precious metals to contact interfaces. This method not only conserves precious metals but also precisely places the deposit to optimize performance. Spot plating requires tooling designed and built and specifically for a particular connector part. The tooling operates on plating equipment that is much more sophisticated than standard plating equipment.

With continuous spot plating, i.e. step and repeat, small well defined round or rectangular spots are produced. To obtain spots in precise locations, pre-punched guide holes are used. This allows parts, on a strip, to move continuously through the pre-plate and post-plate sections. Typically, a 60 centimeter section is indexed per each movement of the materials. This type of plating provides precise location of well-defined and discreet plated spots.

Spot plating equipment pinpoints placement of precious metals and reduces costly waste. It also allows two or more different types of metal plating in the same horizontal plane significantly reducing base metal usage and die width for new contact designs. Nearly any shape can be precisely applied to areas as small as 10 millimeters at high production speeds. Precious metal savings are estimated at up to 70% over conventional plating methods.

Although spot plating has improved precious metal plating, a problem which is frequently reported by workers with respect to hard gold spot plating is gold displacement or "bleed". Gold displacement is the deposition of gold in undesired areas of the substrate which is being plated on nickel containing substrates, such as electrical connectors. The deposition of hard gold in undesired areas of the substrate requires workers to remove the gold from such areas and results in loss of hard gold which the spot plating methods are designed to address. Steps required to selectively remove the excess gold are very difficult and both costly and time consuming due to the small areas where the gold must be removed. This in turn reduces the efficiency of the overall manufacturing process. If the gold is not removed, defects in the substrate result leading to defective end products. The displacement reaction is believed to occur as follows:

$$2Au^{+}+Ni^{\circ}=2Au^{\circ}+Ni^{2+}$$

where the noble gold metal naturally displaces the non-noble nickel.

Gold displacement may be reduced by improving the design of plating equipment; however, this typically requires costly expenditures on the part of equipment manufactures to redesign and then manufacture new parts, especially since spot plating equipment is unconventional and sophisticated. Often when one component part is redesigned for spot plating equipment another part requires modification as well such that all of the component parts work together. This in turn results in increased costs to electronic component manufacturers who use the spot plating equipment and ultimately to the consumer of electronic articles. Less costly and more efficient methods have not yet been developed to address the gold displacement problem. A more efficient approach to addressing the gold displacement problem would be a hard gold plating bath which would substantially inhibit gold displacement. However, to date, the plating industry has not developed such a hard gold plating bath. Accordingly, there is still a need for a method of inhibiting hard gold displacement.

In one aspect a composition includes one or more sources of gold ions, one or more sources of alloying metal ions including cobalt salts or nickel salts, and one or more mercapto-tetrazoles and salts thereof.

In another aspect a method includes: a) providing a composition comprising one or more sources of gold ions, one or more sources of alloying metal ions including cobalt salts or nickel salts, and one or more mercapto-tetrazoles or salts thereof; b) contacting a substrate with the composition; and c) selectively depositing a gold-cobalt or gold-nickel alloy on the nickel or nickel alloy of the substrate.

Addition of the mercapto-tetrazoles to hard gold plating compositions inhibits hard gold displacement on nickel and nickel alloy substrates. The hard gold electroplating compositions containing the one or more mercapto-tetrazoles address the problem of the undesired gold displacement reactions without the need for modifying the specially designed and sophisticated spot plating equipment. Accordingly, the hard gold electroplating compositions provide a more cost effective method of addressing gold displacement than conventional methods. In addition, the functional properties of the hard gold alloys, such as contact resistance and hardness, are not compromised. The contact resistance is maintained at the desired low levels and the gold alloys are sufficiently hard for commercial electrical contacts for electronic devices.

FIGURE is a graph showing contact resistance of hard gold deposits in milliohms versus contact force in centiNewtons.

As used throughout this specification, the following abbreviations shall have the following meanings, unless the context clearly indicates otherwise: ° C.=degrees Centigrade; g=gram; mg=milligrams; L=liter; mL=milliliters; cm=centimeters; mm=millimeters; μm=microns=micrometers; cN=centiNewtons=1/100 of a Newton; Newton=kg·m/s$^2$; mΩ=milliohms=1/1000 of an ohm; ohm=basic unit of electric resistance in the SI and MKS systems, equal to the resistance of a circuit in which an electromotive force of one volt maintains a current of one ampere; ASD=amperes/decimeter squared=A/dm$^2$; psi=pounds per square inch=0.06805 atmospheres and 1 atmosphere=$1.01295\times10^6$ dynes/cm$^2$; 1 psi=0.06805 atmospheres=$6.8948\times10^4$ dynes/cm$^2$; and ASTM=American Standard Testing Method.

The terms "depositing" and "plating" are used interchangeably throughout this specification. Unless otherwise indicated, aromatic compounds having two or more substituents include ortho-, meta- and para-substitution.

All percentages are by weight, unless otherwise noted. All numerical ranges are inclusive and combinable in any order, except where it is logical that such numerical ranges are constrained to add up to 100%.

Compositions include one or more sources of gold ions, one or more sources of alloying metals of cobalt salts or nickel salts, and one or more mercapto-tetrazoles to deposit hard gold on substrates.

One or more gold salts which provide gold (I) ions may be used. Such sources of gold (I) ions include, but are not limited to, alkali gold cyanide compounds such as potassium gold cyanide, sodium gold cyanide, and ammonium gold cyanide, alkali gold thiosulfate compounds such as trisodium gold thiosulfate and tripotassium gold thiosulfate, alkali gold sulfite compounds such as sodium gold sulfite and potassium gold sulfite, ammonium gold sulfite, and gold (I) and gold (III) halides such as gold (I) chloride and gold (III) trichloride. Typically, the alkali gold cyanide compounds are used such as potassium gold cyanide.

The amount of the one or more gold compounds is from 1 g/L to 50 g/L, or such as from 5 g/L to 30 g/L, or such as from 10 g/L to 20 g/L. Such gold compounds are generally commercially available from a variety of suppliers or may be prepared by methods well known in the art.

Optionally, a wide variety of gold complexing agents may be included in the compositions. Suitable gold complexing agents include, but are not limited to, alkali metal cyanides such as potassium cyanide, sodium cyanide and ammonium cyanide, thiosulfuric acid, thiosulfate salts such as sodium thiosulfate, potassium thiosulfate, potassium sorbate and ammonium thiosulfate, ethylenediamine tetraacetic acid and its salts, iminodiacetic acid and nitrilotriacetic acid.

The one or more complexing agents may be added in conventional amounts, or such as in amounts of 1 g/L to 100 g/L, or such as 10 g/L to 50 g/L. The one or more complexing agents are generally commercially available or may be prepared from methods well known in the art.

One or more cobalt compounds may be used. Suitable cobalt compounds include, but are not limited to, cobalt carbonate, cobalt sulfate, cobalt gluconate, cobalt potassium cyanide, cobalt bromide and cobalt chloride.

The amount of the one or more cobalt compounds is from 0.001 g/L to 5 g/L, or such as from 0.05 g/L to 1 g/L. Such cobalt compounds are generally commercially available or may be prepared by methods well known in the art.

One or more nickel compounds may be used. Suitable nickel compounds include, but are not limited to, nickel chloride, nickel bromide, nickel sulfate, nickel tartrate, nickel phosphate and nickel nitrate.

The total amount of the one or more nickel compounds is from 0.001 g/L to 5 g/L, or such as from 0.05 g/L to 1 g/L. Such nickel compounds are generally commercially available or may be prepared by methods well known in the art.

Mercapto-tetrazole compounds which are included in the hard gold plating compositions are five-membered nitrogen containing heterocyclic compounds and salts thereof. Such mercapto-tetrazoles also include mesoionic compounds such as tetrazolium compounds.

Examples of mercapto-tetrazoles have a formula:

(I)

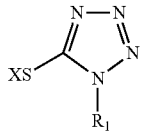

wherein $R_1$ is hydrogen, straight or branched, saturated or unsaturated ($C_1$-$C_{20}$) hydrocarbon group, ($C_8$-$C_{20}$)aralkyl, substituted or unsubstituted phenyl, naphthyl, amine or carboxyl group, and X is hydrogen, ($C_1$-$C_2$)alkyl, or a suitable counter-ion including, but not limited to, alkali metals such as sodium, potassium, lithium, calcium, ammonium, or a quaternary amine. Substituent groups on the phenyl, naphtyl and amine groups include, but are not limited to, branched or unbranched ($C_1$-$C_{20}$)alkyl, branched or unbranched ($C_2$-$C_{20}$) alkylene, branched or unbranched ($C_1$-$C_{12}$)alkoxy, hydroxyl, and halogens such as chlorine and bromine.

Typically, $R_1$ is hydrogen, straight chain, saturated or unsaturated ($C_1$-$C_{20}$) hydrocarbon group, substituted or unsubstituted phenyl or ($C_8$-$C_{20}$)aralkyl and X is hydrogen, sodium, or potassium. More typically, $R_1$ is hydrogen, substituted or unsubstituted phenyl or ($C_8$-$C_{20}$)aralkyl and X is hydrogen. Most typically, $R_1$ is substituted or unsubstituted phenyl and X is hydrogen.

Examples of such mercapto-tetrazoles are 5-(methylthio)-1H-tetrazole, 5-mercapto-1-methyltetrazole, 5-mercapto-1-tetrazoleacetic acid, 5-(ethylthio)-1H-tetrazole, 1-phenyl-1H-tetrazole-5-thiol, 1-(4-hydroxyphenyl)-1H-tetrazole-5-thiol, 1-[2-(dimethylamino)ethyl]-1H-tetrazole-5-thiol and salts thereof.

Examples of tetrazolium compounds are the mesoionic compounds which have a formula:

(II)

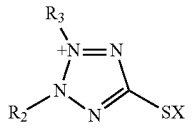

wherein X is defined as above; $R_2$ is a substituted or unsubstituted alkyl, alkenyl, thioalkoxy, or alkoxycarbonyl group having from 1 to 28 carbon atoms; a substituted or unsubstituted cycloalkyl group having from 3 to 28 carbon atoms; a substituted or unsubstituted aryl group having from 6 to 33 carbon atoms; a substituted or unsubstituted heterocyclic ring having from 1 to 28 carbon atoms and one or more hetero atoms such as nitrogen, oxygen, sulfur, or combinations thereof; an alkyl, cycloalkyl, alkenyl, alkoxyalkyl, aryl or phenoxy group connecting to a substituted or unsubstituted aromatic ring; or an alkyl, cycloalkyl, alkenyl, alkoxyalkyl, aryl, or phenoxy group connecting to a substituted or unsubstituted heterocyclic ring having 1 to 28 carbon atoms and one or more heteroatoms such as nitrogen, oxygen, sulfur, or combinations thereof; and $R_3$ is a substituted or unsubstituted amine group having from 0 to 25 carbon atoms, typically 1 to 8 carbon atoms; a substituted of unsubstituted alkyl, alkenyl, or alkoxy group having from 1 to 28 carbon atoms; a substituted or unsubstituted cycloalkyl group from 3 to 28 carbon atoms; a substituted or unsubstituted acyloxy group having from 2 to 25 carbon atoms; a substituted or unsubstituted aryl group having from 6 to 33 carbon atoms; a substituted or unsubstituted heterocyclic ring having from 1 to 28 carbon atoms and one or more hetero atoms, such as nitrogen, oxygen, sulfur or combinations thereof; an alkyl, cycloalkyl, alkenyl, alkoxyalkyl, aryl, or phenoxy group connecting to a substituted or unsubstituted aromatic ring; or an alkyl, cycloalkyl, alkenyl, alkoxyalkyl, aryl, or phenoxy group connecting to a substituted or unsubstituted heterocyclic ring having 1 to 25 carbon atoms and one or more hetero atoms such as nitrogen, oxygen, sulfur or combinations thereof.

In general, the mercapto-tetrazoles, including the tetrazolium compounds, are included in the electrolyte compositions in amounts of 1 mg/L to 5 g/L, or such as from 10 mg/L to 500 mg/L, or such as from 20 mg/L to 80 mg/L. Such mercapto-tetrazoles are generally commercially available or may be prepared by methods well known in the art. Typically, the mercapto-tetrazoles are used in the plating compositions.

Optionally, the hard gold plating compositions may include pyridine or quinoline compounds, such as substituted pyridine or quinoline compounds. Such compounds are included in amounts of 1 g/L to 10 g/L. Such compounds are capable of increasing the deposition rate of gold alloy plating and improving the uniformity of the deposit. Typically these compounds are mono- or dicarboxylic acid, mono- or dithiol substituted pyridines, quinolines, pyridine derivatives or quinoline derivatives. The pyridine or quinoline derivatives may be substituted in one or more positions and may be mixed substituents.

Typically pyridine derivatives substituted in the 3-position of the pyridine ring are used. Examples of such pyridine derivatives include pyridine carboxylic acids, and pyridine thiols. The pyridine carboxylic acids typically used are esters or amides. Specific examples are pyridine-3-carboxylic acid, quinoline-3-carboxylic acid, 20 or 4-pyridine carboxylic acids, nicotinic acid methyl ester, nicotinamide, nicotinic acid diethyl amide, pyridine-2,3-dicarboxylic acid, pyridine-3,4-dicarboxylic acid and pyridine-4-thioacetic acid.

The hard gold plating compositions may include one or more organic or inorganic acid, such as phosphoric acid, phosphonic acid, phosphinic acid, citric acid, malic acid, oxalic acid, formic acid or polyethylene amino acetic acid. Such acids help maintain the pH of the compositions in a range of 2 to 6. Typically the acids are included in amounts of 1 g/L to 200 g/L Alkaline compounds also may be added to maintain the pH of the compositions at desired levels. Such alkaline compounds include, but are not limited to, hydroxides, sulfates, carbonates, phosphates, hydrogen phosphates and other salts of sodium, potassium and magnesium. For example, KOH, $K_2CO_3$, $Na_2CO_3$, $Na_2SO_4$, $MgSO_4$, $K_2HPO_4$, $Na_2HPO_4$, $Na_3PO_4$ and mixtures thereof are suitable alkaline compounds. Typically, the alkaline materials are included in amounts of 1 g/L to 100 g/L The compositions also may include one or more surfactants. Any suitable surfactant may be used in the compositions. Such surfactants include, but are not limited to, alkoxyalkyl sulfates (alkyl ether sulfates) and alkoxyalkyl phosphates (alkyl ether phosphates). The alkyl and alkoxy groups typically contain from 10 to 20 carbon atoms. Examples of such surfactants are sodium lauryl sulfate, sodium capryl sulfate, sodium myristyl sulfate, sodium ether sulfate of a $C_{12}$-$C_{18}$ straight chain alcohol, sodium lauryl ether phosphate and corresponding potassium salts.

Other suitable surfactants which may be used include, but are not limited to, N-oxide surfactants. Such N-oxide surfactants include, but are not limited to, cocodimethylamine N-oxide, lauryldimethylamine N-oxide, oleyldimethylamine N-oxide, dodecyldimethylamine N-oxide, octyldimethylamine N-oxide, bis-(hydroxyethyl)isodecyloxypropylamine N-oxide, decyldimethylamine N-oxide, cocamidopropyldimethylamine N-oxide, bis(hydroxyethyl) $C_{12}$-$C_{15}$ alkoxypropylamine N-oxide, lauramine N-oxide, lauramidopropyldimethylamine N-oxide, $C_{14}$-$C_{16}$ alkyldimethylamine N-oxide, N,N-dimethyl (hydrogenated tallow alkyl) amine N-oxide, isostearamidopropyl morpholine N-oxide, and isostearamidopropyl pyridine N-oxide.

Other suitable surfactants include, but are not limited to, betaines, and alkoxylates such as the ethylene oxide/propylene oxide (EO/PO) compounds. Such surfactants are well known in the art.

Many of the surfactants may be commercially obtained or made by methods described in the literature. Typically, the surfactants are included in the compositions in amounts of 0.1 g/L to 20 g/L.

The hard gold plating compositions also may include other conventional additives known in the art to assist in the alloy deposition processes, such as brighteners and grain refiners. Such additives are included in conventional amounts.

The components of the compositions may be combined by any suitable method known in the art. Typically, the components are mixed in any order and the compositions are brought to a desired volume by adding sufficient water. Some heating may be necessary to solubilize certain composition components.

The gold-cobalt and gold-nickel alloys may be selectively electroplated from the compositions onto precise locations on substrates using spot plating processes and apparatus known in the art. The mercapto-tetrazoles in the hard gold plating compositions inhibit gold displacement of nickel on the substrates. The hard gold electroplating compositions may be used to plate hard gold on any substrate where gold displacement is a problem. Typically, the hard gold is spot plated at contact interfaces of electrical connectors where precise gold deposition is required.

In one method the hard gold may be deposited by a masking method. This technique involves the use of a thin Mylar tape or rubber mask which is tooled by prepunching holes where plating is desired. The mask is then compressed against the nickel strip which is to be plated with the hard gold as it passes over the plating cells. Strip widths as narrow as 0.02 cm and spots of 0.5 cm in diameter may be produced with tolerances of ±0.01. Typically, 5 to 20 spots are plated at the same time.

In another method the spot plating method begins when a metal substrate, such as an electrical connector composed of nickel on copper is fed to a plating station where it is supported and positioned under a stationary assembly including at least one jet forming tubular member having a nozzle opening of predetermined size arranged at a preferred distance from the outlet. Nozzle diameters may vary depending on the particular apparatus. In general, nozzle diameters are 10 mm and less. Typically, a plurality of jet forming tubular members is used having a plurality of nozzles. At the plating station the substrate is electrically connected as a cathodic element to a power source. A stream of the hard gold plating composition flows from an electrolyte reservoir under the force of a hydrostatic head pressure and is in fluid communication with the nozzles. Pressures may range from as low as 1 psi to as high as 100 psi and higher depending on the particular spot plating apparatus. The plating composition continuously flows over an anode element. The anode element may be a consumable or non-consumable electrode. Such electrodes are well known in the art. In some spot plating apparatus the nozzle itself is the anode in which case a separate anode component is excluded from the apparatus. Nozzle anodes may be of stainless steel. A predetermined voltage is applied between the anodic element and the cathodic element to selectively spot plate the substrate with a spot or a strip of hard gold. Voltages may vary. Typically voltages across the cathode and the anode range from 5 volts to 50 volts. The spot or strip of hard gold is approximately the same size as the opening of the nozzles. Feature sizes deposited by spot plating may have widths or diameters of 10 mm or less, typically from 1 mm to 5 mm. An example of a method and apparatus for spot plating is disclosed in U.S. Pat. No. 4,591,415.

Typically, current densities used range from 0.05 ASD to 100 ASD, or such as from 1 ASD to 50 ASD. Typically, the current density is 5 ASD to 20 ASD.

Plating times may vary. The amount of time depends on the desired thickness of the gold-cobalt or gold-nickel alloy on the substrate. Typically, the thickness of the alloy is from 0.01 microns to 2 microns, or such as from 0.1 microns to 1 micron, or such as from 0.2 microns to 0.5 microns.

The gold-cobalt alloys, in general, have a gold content of 98 wt % to 99.95 wt % and a cobalt content of 0.01 wt % to 2 wt %. The gold-nickel alloys, in general, have a gold content of 98 wt % to 99.95 wt % and a nickel content of 0.01 wt % to 2 wt %.

Addition of one or more mercapto-tetrazoles inhibits gold displacement of nickel, while at the same time does not compromise gold alloy appearance. In addition, the functional properties of the hard gold alloys, such as contact resistance and hardness, are not compromised either. The contact resistance is maintained at the desired low levels, typically 5 milliohms or less, and the gold alloys are sufficiently hard for commercial electrical contacts for electronic devices. The hard gold electroplating compositions containing the one or more mercapto-tetrazoles address the problem of the undesired gold displacement reactions without the need for modifying the specially designed and sophisticated spot plating equipment. Accordingly, the hard gold electroplating compositions provide a more cost effective method of addressing gold displacement than conventional methods.

While the method of plating hard gold is described in reference to spot plating and hard gold plating electrical connectors, it is envisioned that the plating compositions may be used to deposit the hard gold by other conventional electroplating processes and on other substrates. Such processes and substrates are known to those of skill in the art.

The following examples are intended to illustrate the invention, but are not intended to limit its scope.

EXAMPLE 1

Comparative

An aqueous hard gold electroplating bath having the following composition was prepared:

| COMPONENT | AMOUNT |
|---|---|
| Gold as potassium gold cyanide | 15 g/L |
| Cobalt as cobalt carbonate | 0.7 g/L |
| Citric acid | 65 g/L |
| Dicarboxylic acid chelating agents | 50 g/L |
| Potassium hydroxide | Amount to adjust pH to 4-5 |
| Water | To one liter |
| Temperature | 60° C. |

Five double sided nickel pre-plated copper test panels 10×5 $mm^2$ were immersed in 500 mL baths of the gold-cobalt alloy plating bath for 12 minutes. The baths were agitated using a magnetic stirrer during the entire 12 minutes. After the 12 minute period, the coupons were removed from the baths, rinsed with deionized water and air dried. The coupons were then analyzed for gold displacement of nickel on the coupons by X-ray fluorescence. A Fischerscope X-ray XDV apparatus from Helmut Fischer was used. The analysis results showed that an average of 0.096 microns of gold was plated on the nickel of the coupons.

EXAMPLE 2

An aqueous hard gold plating bath of the following formula is prepared:

| COMPONENT | AMOUNT |
|---|---|
| Gold as potassium gold cyanide | 15 g/L |
| Cobalt as cobalt carbonate | 0.7 g/L |
| Citric acid | 65 g/L |
| Dicarboxylic acid chelating agents | 50 g/L |
| 1-(2-dimethylaminoethyl)-5-mercapto-1,2,3,4-tetrazole | 500 mg/L |
| Potassium hydroxide | Amounts to adjust pH to 4-5 |
| Water | To one liter |
| Temperature | 60° C. |

Five double sided nickel pre-plated copper test panels 10×5 $mm^2$ were immersed in a 500 mL bath of the gold-cobalt alloy plating baths for 12 minutes. The baths were agitated using a magnetic stirrer during the entire 12 minutes. After the 12 minute period, the coupons were removed from the baths, rinsed with deionized water and air dried. The coupons were then analyzed for gold displacement of nickel on the coupons by X-ray fluorescence using a Fischerscope X-ray XDV apparatus. The analysis results showed that an average of only 0.005 microns of gold was plated on the nickel of the coupons. The amount of displacement was less than that in Example 1 where the hard gold bath did not include 1-(2-dimethylaminoethyl)-5-mercapto-1,2,3,4-tetrazole.

EXAMPLE 3

Contact resistance of the hard gold plated samples from Examples 1 and 2 were tested to show that there was no significant change in desired low contact resistance between the hard gold samples plated with the compositions containing the anti-displacement compound versus the hard gold plating composition which excluded the anti-displacement compound. Each hard gold plated sample was tested for contact resistance at ten different contact forces and the average contact resistance was recorded for each contact force. Multiple contact forces were used to test the contact resistance since there are different standards for contact resistance for different contact forces or loads in the industry for electrical connectors. The contact resistance was measured using KOWI 3000 system according to ASTM 667-97. The table below discloses the contact forces applied and the average contact resistance at the given contact force.

| Contact Force | Contact Resistance (mΩ) | |
|---|---|---|
| (cN) | Example 1 | Example 2 |
| 3 | 2.36 | 2.48 |
| 5 | 2.33 | 2.66 |
| 10 | 2.04 | 2.09 |
| 20 | 1.45 | 1.56 |
| 30 | 1.3 | 1.23 |
| 40 | 1.29 | 1.2 |
| 50 | 1.21 | 1.17 |
| 60 | 1.13 | 1.1 |

-continued

| Contact Force (cN) | Contact Resistance (mΩ) Example 1 | Example 2 |
|---|---|---|
| 70 | 1.13 | 1.03 |
| 90 | 0.98 | 0.99 |

The data in the table was plotted as shown in the FIGURE of contact resistance versus contact force. The data showed that the contact resistance of the hard gold deposit which was plated from the composition containing the anti-displacement compound was substantially the same as that of the hard gold deposit plated from the composition which did not include the anti-displacement compound. Accordingly, the addition of the anti-displacement compound did not compromise the desired low contact resistance of the hard gold deposits of Example 2.

EXAMPLE 4

The hard gold samples plated in Examples 1 and 2 were tested for their hardness. An acceptable hardness range for commercial contacts is Vickers hardness of 110 HV to 170 HV using ASTM B 578-87 Micro-Hardness indentation testing method. A diamond-pyramid head was used to test the hardness of each plated sample. The average hardness was determined for the samples in Example 1 and Example 2. The average hardness for the samples in Example 1 was determined to be 145 HV±10 and the average hardness for the samples in Example 2 was determined to be 140 HV±10. There was no substantial difference between the hardness for the hard gold deposits plated with the compositions containing the anti-displacement compound versus the hard gold deposits which did not include the anti-displacement compound. Further, the hard gold deposits which included the anti-displacement compound had a hardness value which fell within the desired hardness range for commercial purposes.

EXAMPLE 5

The hard gold samples plated in Examples 1 and 2 were tested for their corrosion resistance using the ASTM B 735-06 nitric acid method. Each hard gold plated sample from Examples 1 and 2 were exposed to nitric acid vapor for 60 minutes under an enclosed fume hood. The samples were removed and visually examined twenty-four hours later for porosity on the surface of the plated samples which was indicative of corrosion. The hard gold plated samples from Example 1 had from 0 to 3 observable points of corrosion. The samples from Example 2 which were plated with the hard gold composition which included the anti-displacement compound had substantially the same corrosion results as the samples from Example 1. There were no substantial differences in the corrosion results between the hard gold deposits of Examples 1 and 2. The anti-displacement compound did not compromise the corrosion resistance of the hard gold deposits of Example 2.

EXAMPLE 6

An aqueous hard gold plating bath having the following formulation is prepared:

| COMPONENT | AMOUNT |
|---|---|
| Gold as potassium gold cyanide | 20 g/L |
| Cobalt as cobalt gluconate | 1 g/L |
| Malic acid | 50 g/L |
| Nitriloacetic acid | 20 g/L |
| Potassium cyanide | 60 mg/L |
| 5-mercapto-1-methyltetrazole | 100 mg/L |
| Potassium hydroxide | Amounts to adjust pH to 4-5 |
| Water | To one liter |
| Temperature | 50° C. |

A double sided nickel pre-plated copper test panel 10×5 $mm^2$ is immersed in a 500 mL bath of the gold-cobalt alloy plating bath for 15 minutes. The bath is agitated using a magnetic stirrer during the entire 15 minutes. After the 15 minute period, the coupon is removed from the bath, rinsed with deionized water and air dried. The coupon is then analyzed for gold displacement of nickel on the coupon by X-ray fluorescence. The analysis results are expected to show that less than 0.01 microns of gold is plated on the nickel of the coupon.

EXAMPLE 7

An aqueous hard gold plating bath having the following formula is prepared:

| COMPONENT | AMOUNT |
|---|---|
| Gold as potassium gold cyanide | 10 g/L |
| Cobalt sulfate | 0.5 g/L |
| Oxalic acid | 30 g/L |
| Nicotinic acid | 5 g/L |
| Formic acid | 5 g/L |
| 5-mercapto-1-tetrazoleacetic acid | 70 mg/L |
| Potassium hydroxide | Amounts to adjust pH to 3-5 |
| Water | To one liter |
| Temperature | 65° C. |

A double sided nickel pre-plated copper test panel 10×5 $mm^2$ is immersed in a 500 mL bath of the gold-cobalt alloy plating bath for 15 minutes. The bath is agitated using a magnetic stirrer during the entire 15 minutes. After the 15 minute period, the coupon is removed from the bath, rinsed with deionized water and air dried. The coupon is then analyzed for gold displacement of nickel on the coupon by X-ray fluorescence. The analysis results are expected to show that less than 0.01 microns of gold is plated on the nickel of the coupon.

EXAMPLE 8

An aqueous hard gold plating bath having the following formula is prepared:

| COMPONENTS | AMOUNTS |
|---|---|
| Gold as potassium gold cyanide | 25 g/L |
| Cobalt as cobalt carbonate | 0.2 g/L |
| Nicotinic acid | 5 g/L |
| Potassium cyanide | 500 mg/L |
| Citric acid | 50 mg/L |
| 1-phenyl-5-mercapto-1,2,3,4-tetrazole | 80 mg/L |
| Malic acid | 20 g/L |

-continued

| COMPONENTS | AMOUNTS |
|---|---|
| Potassium Hydroxide | Amounts to adjust pH to 3-5 |
| Water | To one liter |
| Temperature | 50° C. |

A double sided nickel pre-plated copper test panel 10×5 $mm^2$ is immersed in a 500 mL bath of the gold-cobalt alloy plating bath for 20 minutes. The bath is agitated using a magnetic stirrer during the entire 20 minutes. After the 20 minute period, the coupon is removed from the bath, rinsed with deionized water and air dried. The coupon is then analyzed for gold displacement of nickel on the coupon by X-ray fluorescence. The analysis results are expected to show that less than 0.01 microns of gold is plated on the nickel of the coupon.

EXAMPLE 9

An aqueous hard gold plating bath having the following formula is prepared:

| COMPONENTS | AMOUNTS |
|---|---|
| Gold as potassium gold cyanide | 50 g/L |
| Nickel as nickel chloride | 0.5 g/L |
| Nicotinic acid | 5 g/L |
| Potassium cyanide | 500 mg/L |
| Citirc acid | 10 g/L |
| 1-{2-(dimethylamino)ethyl]-1H-tetrzole-5-thiol | 50 mg/L |
| Malic acid | 20 g/L |
| Potassium Hydroxide | Amounts to adjust pH to 4-5 |
| Water | To one liter |
| Temperature | 50° C. |

A double sided nickel pre-plated copper test panel 10×5 $mm^2$ is immersed in a 500 mL bath of the gold-nickel alloy plating bath for 15 minutes. The bath is agitated using a magnetic stirrer during the entire 15 minutes. After the 15 minute period, the coupon is removed from the bath, rinsed with deionized water and air dried. The coupon is then analyzed for gold displacement of nickel on the coupon by X-ray fluorescence. The analysis results are expected to show that less than 0.01 microns of gold is plated on the nickel of the coupon.

EXAMPLE 10

An aqueous hard gold plating bath having the following formula is prepared:

| COMPONENT | AMOUNT |
|---|---|
| Gold as potassium gold cyanide | 20 g/L |
| Nickel sulfate | 0.5 g/L |
| Oxalic acid | 30 g/L |
| Organophosphonic acid | 30 g/L |
| Nicotinic acid | 5 g/L |
| Formic acid | 5 g/L |
| 5-(ethylthio)-1H-tetrazole | 60 mg/L |
| Potassium hydroxide | Amounts to adjust pH to 3-5 |
| Water | To one liter |
| Temperature | 65° C. |

A double sided nickel pre-plated copper test panel 10×5 $mm^2$ is immersed in a 500 mL bath of the gold-nickel alloy plating bath for 15 minutes. The bath is agitated using a magnetic stirrer during the entire 15 minutes. After the 15 minute period, the coupon is removed from the bath, rinsed with deionized water and air dried. The coupon is then analyzed for gold displacement of nickel on the coupon by X-ray fluorescence. The analysis results are expected to show that less than 0.01 microns of gold is plated on the nickel of the coupon.

EXAMPLE 11

Five nickel coated electrical connectors are cleaned with dilute nitric acid. The gold-cobalt alloy electroplating bath is that which is described in Example 2 above. Sufficient volume of the gold-cobalt alloy bath is placed in the electrolyte reservoir of a Meco-Wheel reel-to-reel selective plating tool (manufactured by Meco Equipment Engineers B.V.). A spot plate of gold-cobalt alloy is formed at a contact interface on each electrical connector when passing through the plating solution together with the turning wheel at a current of 10 ASD.

Each gold-cobalt plated electrical connector is then analyzed by X-ray fluorescence for gold displacement of nickel in parts adjacent to the spot plated tips of the connectors. The analysis is expected to show no gold displacement of nickel.

What is claimed is:

1. A composition consisting of one or more sources of gold ions, one or more sources of alloying metal ions selected from the group consisting of cobalt salts or nickel salts, one or more mercapto-tetrazoles or salts thereof, and one or more additives selected from the group consisting of inorganic acids, pyridine carboxylic acids, pyridine thiols, esters of pyridine carboxylic acids, amides of pyridine carboxylic acids, quinoline derivatives, gold complexing agents, citric acid, malic acid, oxalic, acid polyethylene amino acetic acid, alkaline materials and surfactants, and water.

2. The composition of claim 1, wherein the one or more mercapto-tetrazoles has a formula:

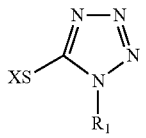

wherein $R_1$ is hydrogen, straight or branched, saturated or unsaturated ($C_1$-$C_{20}$) hydrocarbon group, ($C_8$-$C_{20}$) aralkyl, substituted or unsubstituted phenyl, naphthyl, amine or carboxyl group, and X is hydrogen, ($C_1$-$C_2$) alkyl, sodium ion, potassium ion, lithium ion, calcium ion, ammonium ion or quaternary amine ion.

3. The composition of claim 1, wherein the mercapto-tetrazole comprises from 1 mg/L to 5 g/L of the composition.

4. A method comprising:

a. providing a composition consisting of one or more sources of gold ions, one or more sources of alloying metal ions selected from the group consisting of cobalt salts or nickel salts, one or more mercapto-tetrazoles or salts thereof and one or more additives selected from the group consisting of inorganic acids, pyridine carboxylic acids, pyridine thiols, esters of pyridine carboxylic acids, amides of pyridine carboxylic acids, quinoline derivatives, gold complexing agents, citric acid, malic acid, oxalic acid, polyethylene amino acetic acid, alkaline materials and surfactants, and water;

b. contacting a substrate with the composition; and c. selectively depositing a gold-cobalt or gold-nickel alloy on the substrate.

5. The method of claim 4, wherein the mercapto-tetrazole has a formula:

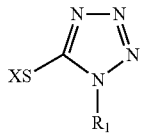

wherein $R_1$ is hydrogen, straight or branched, saturated or unsaturated ($C_1$-$C_{20}$) hydrocarbon group, ($C_8$-$C_{20}$) aralkyl, substituted or unsubstituted phenyl, naphthyl, amine or carboxyl group, and X is hydrogen, ($C_1$-$C_2$) alkyl, sodium ion, potassium ion, lithium ion, calcium ion, ammonium ion or quaternary amine ion.

6. The method of claim 4, wherein the substrate is an electrical connector.

* * * * *